United States Patent [19]

Pasternak

[11] Patent Number: 4,670,998

[45] Date of Patent: Jun. 9, 1987

[54] NAVICULAR SUPPORT TENNIS SHOE

[75] Inventor: Stephen M. Pasternak, Toms River, N.J.

[73] Assignee: Chesebrough-Pond's, Inc., Greenwich, Conn.

[21] Appl. No.: 823,210

[22] Filed: Jan. 28, 1986

[51] Int. Cl.[4] ..... A43B 5/00

[52] U.S. Cl. ..... 36/114; 36/89; 36/121

[58] Field of Search ..... 36/114, 121, 89, 90, 36/91, 92, 136

[56] References Cited

U.S. PATENT DOCUMENTS

| | | | |
|---|---|---|---|
| D. 112,344 | 11/1938 | Lutz | D2/313 |
| D. 228,267 | 9/1973 | Powers | D2/309 |
| D. 265,015 | 6/1982 | Higgins | D2/309 |
| 1,988,784 | 1/1935 | Carrier | 36/59 |
| 2,539,761 | 1/1951 | Whitman | 36/114 |
| 3,138,880 | 6/1964 | Kunzli | 36/114 |
| 3,234,667 | 2/1966 | Boway | 36/58.5 |
| 3,327,410 | 6/1967 | Park et al. | 36/114 |
| 3,768,182 | 10/1973 | Powers | 36/2.5 |
| 4,282,657 | 8/1981 | Antonious | 36/114 |
| 4,366,631 | 1/1983 | Larsen et al. | 36/114 |
| 4,441,265 | 4/1984 | Burns | 36/89 |
| 4,476,639 | 10/1984 | Zaccaria | 36/114 |
| 4,516,337 | 5/1985 | Adamik | 36/136 |
| 4,547,981 | 10/1985 | Thais et al. | 36/114 |
| 4,547,982 | 10/1985 | Gamm | 36/136 |
| 4,547,983 | 10/1985 | Brandt | 36/131 |
| 4,571,856 | 2/1986 | Lin et al. | 36/114 |

FOREIGN PATENT DOCUMENTS

| | | | |
|---|---|---|---|
| 149573 | 11/1985 | European Pat. Off. | 36/114 |
| 827130 | 9/1937 | France | 36/89 |
| 1258562 | 5/1960 | France | 36/114 |

*Primary Examiner*—Werner H. Schroeder
*Assistant Examiner*—Mary A. Ellis
*Attorney, Agent, or Firm*—Brumbaugh, Graves, Donohue & Raymond

[57] ABSTRACT

A sports shoe, preferably for tennis includes a rigid stirrup member with a pair of first portions that extend downwardly and rearwardly, on opposite sides of the shoe, to the sole, and a second portion that extends around the back of the shoe and is connected between the first portions. The first portion on the inside part of the shoe extends over the navicular bone, and the second portion extends behind the calcaneous bone of the foot. When the first portions are fastened together, the stirrup member encapsulates the calcaneous, navicular, and talus bones to provide medio-lateral support to critical stress-bearing bones and joints.

14 Claims, 5 Drawing Figures

NAVICULAR SUPPORT TENNIS SHOE

BACKGROUND OF THE INVENTION

The invention is an improvement in sports shoes, and in particular tennis shoes, that provides improved support of the foot during active sports.

Tennis and other active sports can impart severe stresses to the bones, ligaments, and muscles of the foot, particularly during stopping, turning, and lateral movements on the court. During such movements, the foot tends to move in the shoe. When this happens, the foot muscles and muscles in the leg tend to work harder to try to compensate for the movement. This causes fatigue, and ankle or knee injuries can occur due to the strain of overcompensating muscles. It is desirable that tennis footwear, as well as other sports shoes, be designed to support the foot in the appropriate areas to prevent this excess movement.

U.S. Pat. No. 2,539,761 to Whitman discloses a sneaker that includes flexible retention straps on either side of the foot to prevent the foot from sliding forward in the shoe, and to provide side balance. The bottoms of the straps are secured to the sole in positions immediately to the rear of the heads of the first and fifth metatarsal bones of the foot, and extend rearwardly and upwardly over the instep (arch).

U.S. Pat. No. 3,768,182 to Powers discloses a shoe with soft side walls and a pair of reinforcing overlays on either side of the shoe. The bottom of the overlay extends between a point immediately behind the ball of the foot to a point immediately behind the arch, with a cutout portion therebetween. The overlays extend forwardly and upwardly from their bottom portions and cover a substantial part of the forward portion of the foot.

When the foot moves in the shoe, for example when stopping or turning, to the extent that these known reinforcing members constrain movement of the foot, they do so by exerting a force on the arch, in a direction perpendicular to the longitudinal direction of the foot. Also, these straps are designed principally to support the bones and joints only in the forward part of the foot. Furthermore, the degree of lateral support such straps can provide is limited. It would be desirable to provide improved lateral support to the principal stress-bearing bones, to limit the movement thereof, and to provide such support both in the forward and rear portions of the foot.

SUMMARY OF THE INVENTION

The present invention is a sports shoe, in particular a court shoe, and most specifically a tennis shoe, that provides improved lateral and longitudinal support to the foot while stopping, starting, and turning, to decrease fatigue, increase responsiveness of the leg muscles, and minimize foot and leg injuries.

In particular, the present invention is a sports shoe, with a sole and an upper, that includes a tension bearing support member on the inner side of the shoe that extends downwardly and rearwardly over the area of the navicular bone of the foot, and which is connected, in tension bearing engagement, to the sole and to the rear of the shoe, behind the os calcis bone of the foot, to provide medio-lateral support between the os calcis and navicular bones.

In one preferred embodiment, the support member is in the form of a rigid stirrup. The stirrup has opposite free ends overlying the foot, forward of the shoe opening for the foot, a pair of opposed first portions that extend downwardly and rearwardly on each side of the upper and which are attached to the sole, and a second portion that extends between the first portions, around the back of the shoe behind the opening. A fastening means is provided for attaching the free ends to one another in tension, so as to draw the support stirrup on the inner side of the shoe against the navicular bone, thereby to engage and support the navicular, talus, and os calcis bones.

Preferably, the upper is made of a relatively pliable material, and the support member is made of rigid material, e.g. a high modulus, low elongation plastic. The stirrup member may be attached to the upper by stitching along the edges of the stirrup, and preferably the heel of the shoe is provided with a stiffening member between the stirrup and the sole so that such members form a unitary stiff heel portion.

A support member in accordance with the invention provides medio-lateral stability of the sub-talar joint. It moreover prevents valgus and varus (angulation) from occuring by encapsulating the os calcis and talus bones. It also tends to prevent pronation (eversion and abduction), because the medio and lateral walls of the shoe form a rigid stirrup that controls abnormal motion of the foot from side-to-side. Pronation is inhibited in view of the fact that the support member in accordance with the invention supports the sub-talar joint from behind the heel, rather than imparting a downward force on the arch.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
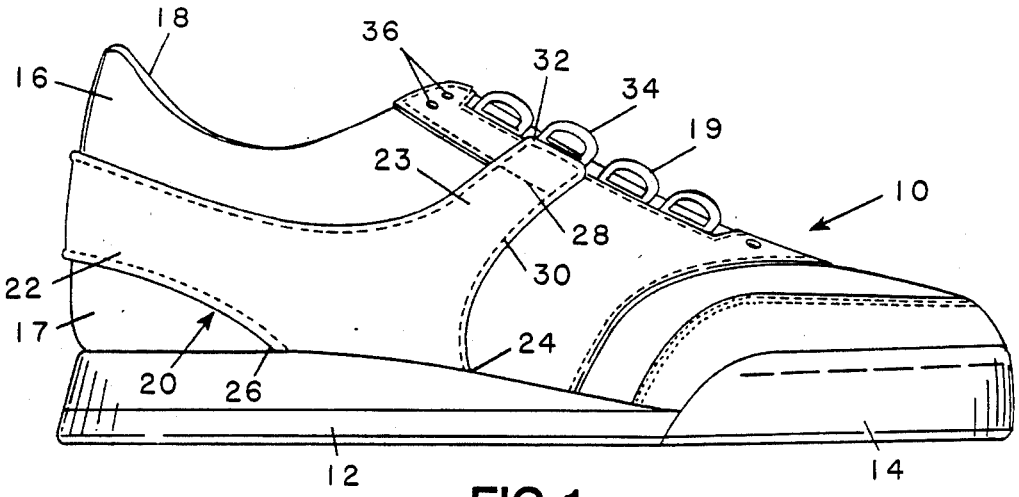
FIG. 1 is a side view of a left shoe of a first embodiment of the invention, showing the inner side of the shoe.
Figure 2:
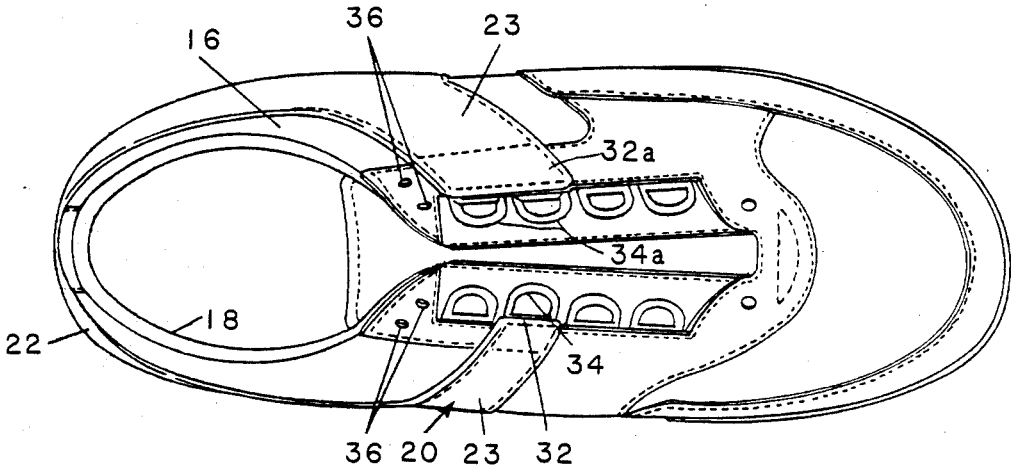
FIG. 2 is a top view of the shoe shown in FIG. 1.
Figure 3:
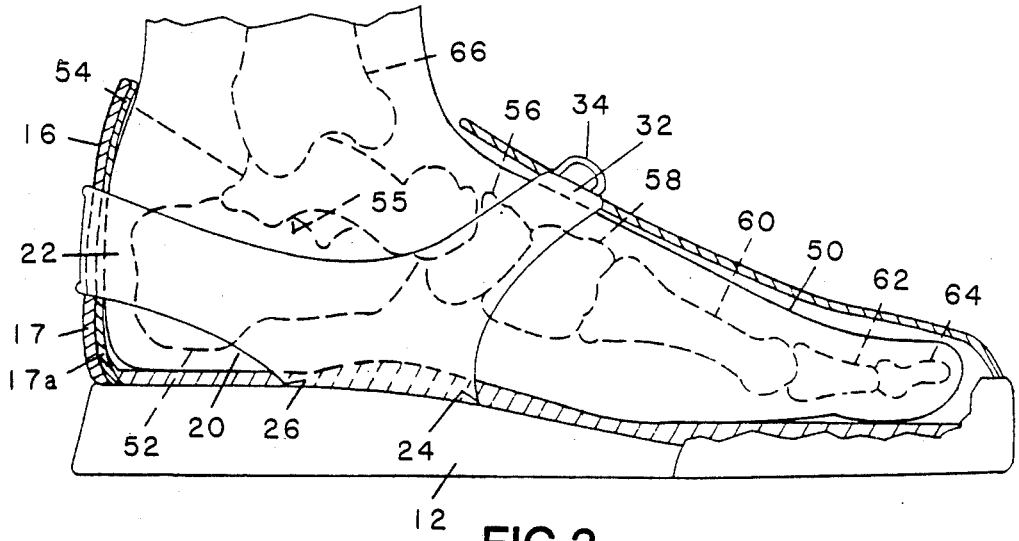
FIG. 3 is a cut-away side view of the shoe shown in FIG. 1, and illustrating the anatomical relationship between the bone structure of a foot and the support member of the invention.

Referring to FIGS. 1–3, a sports shoe 10 in accordance with the invention includes a sole 12 and an upper 16. The sole 12 may be formed of polyurethane, rubber or other material. The forward portion of the sole, corresponding to the ball of the foot, is normally more flexible than the thicker rear portion, corresponding to the heel. If desired, the forward portion of the sole 12 may include an insert member 14 of a more wear-resistant material, in accordance with the teachings of U.S. patent application No. 668,294, filed Jan. 2, 1985, which application is assigned to the assignee of the present invention.

The upper 16 is preferably formed of a relatively soft, pliable material, such as leather, canvas, or nylon, and may include an inside cushioning liner in a manner well known. The upper includes a foot receiving opening 18, and a plurality of lacing eyelets 19 for tying the shoe around the foot. A rigid stirrup or support member 20 overlies the upper 16, and includes a pair of first portions 23, lying on opposite sides of the shoe, and a second portion 22 that extends between the first portions 23 behind the opening 18, around behind the back of the shoe.

The first portions 23 of the stirrup member 20 include free upper ends 32, 32*a*. Each first portion 23 extends downwardly and rearwardly from its free upper end 32 to the rear portion of the sole 12, preferably joining the sole at a point 24 forward of the calcaneus bone as described further on. FIG. 1 shows the lower end of the first portion 23, lying on the inner side of the shoe and extending from points 24 to 26. This lower end 24–26 engages the sole 12 in an area to the rear of the free upper end 32 of the first portion. The first portion lying on the outside part of the shoe may engage the sole along a complimentary portion lying on the other side, but the areas of engagement need not be exactly the same.

The second portion 22 of the stirrup 20 extends rearwardly and upwardly from the first portion 23 around back behind the shoe, and down and forward to the first portion 23 lying on the outside part of the upper 16.

As shown in FIG. 3, preferably the rear portion 17 of the shoe upper includes a stiffening member 17*a* that extends from the sole 12 at least to the bottom of the rear portion 22 of the stirrup 20, such that the stirrup rear portion 22 and counter 12*a* form a unitary stiff shoe heel portion 17. Also, the stirrup is preferably attached to the upper, for example by stitches 30 along its outer edges. The upper end 32 of the inside part of the stirrup includes an eyelet 34, and the upper end 32*a* of the outside part of the stirrup includes a pair of eyelets 34*a*. Preferably, the stitching 30 terminates short of the upper edges, as shown at 28. The shoe may be tied by inserting laces (not shown) through the eyelets 19, 34 and 34*a* of the upper and of the stirrups. Preferably also, smaller holes 36 are provided adjacent the foot-receiving opening 18, at the upper end of the laces. Each end of the laces may be inserted through one pair of holes 36. When the laces are tied, the holes 36 help prevent slipping of the laces and thereby releasing of the lacing force.

FIG. 3 includes a phantom illustration of the bones that lie on the inside portion of the foot 50, inside a shoe having a support member 20 in accordance with the invention. A left foot is shown in FIG. 3 and includes the calcaneus or os calcis bone 52, the talus or astragalus bone 54, the navicular or scaphoid bone 56, the internal cuniform bone 58, the first metatarsal bone 60, and two of the phalanges 62, 64. The tibia bone 66 is also shown in FIG. 3, where it joins the talus bone 54.

The first portion 23 of the support member 20, on the inner side of the foot, extends over the navicular bone 56, and has a width roughly equivalent to the area of the navicular bone 56 to provide lateral support thereto. The attachment at points 24, 26 of the first portion 23 to the sole 12 acts as an anchor for the stirrup 20, but as shown, the rear portion 22 extends behind the calcaneus bone 52 such that, when lateral stress is placed on the foot, the stirrup 20 acts to grip the calcaneus and navicular bones. Thus, support is provided in a direction between the navicular bone 56 and the calcaneus bone 52, with the talus bone 54 lying therebetween. The force imparted involves the sub-talar joint 55 from behind the heel, in a direction perpendicular to the sub-talar axis, rather than pulling in the direction of the arch. This structure provides desirable lateral support for the major bones of the foot.

When a sudden movement is imparted to the foot, such movement is transmitted to support member 20 which causes tightening of the laces between eyelets 34. Sideways movement causes navicular bone 56 and the calcaneus bone 52 to bear against the support member 20 to prevent abnormal displacement. Force is imparted in a direction perpendicular to the sub-talar joint 55.

As a result, a support member 20 in accordance with the invention provides medio-lateral stability to the sub-talar joint 55. It inhibits valgus and varus, i.e. an outward angulation or an inward angulation of the foot, by encapsulating the os calcis 52 and talus 54, and inhibits pronation, that is, eversion (outward twisting) and abduction (inward twisting) in the tarsal and metatarsal joints.

The first portion of the stirrup 23 on the outside of the foot need not be the same either in width or orientation as that on the inside of the foot. In the example shown, the first portion is wider on the outside part of the foot than on the inside. As discussed above, preferably the first portions and second portion are one piece and made of a relatively rigid plastic material.

It may be possible to eliminate the outside portion of the support member provided that the rear portion 23 that supports the inside first member 23 is connected in tension bearing relationship to the rear of the shoe to impart a rearward component of force on the first member 23, and provided that the upper and 32 can be attached in tension bearing engagement with the outside of the upper, such that force is transmitted in a direction between the os calcis 52 and the navicular 56 bones.

Figure 4:
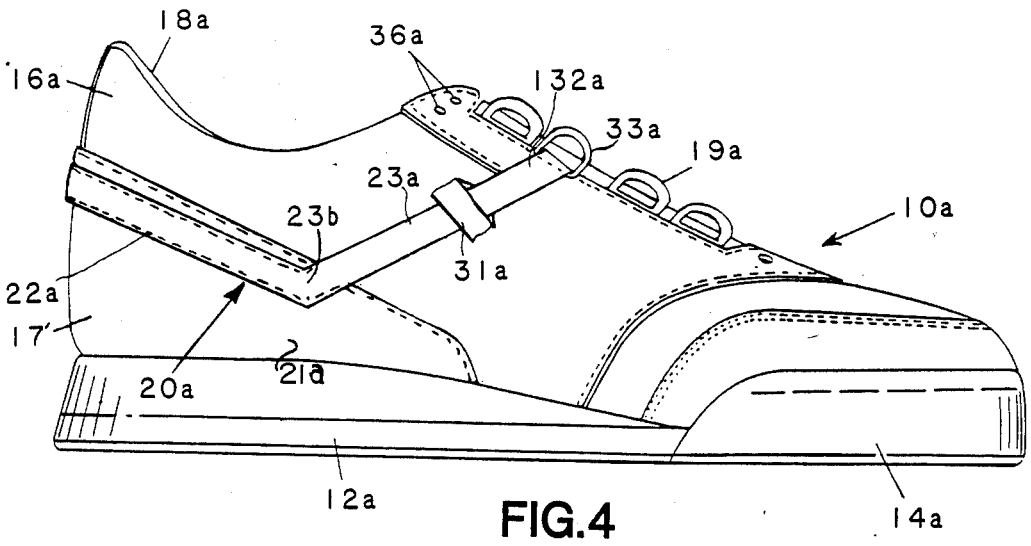
FIG. 4 is a side view of a left shoe of a second embodiment of the invention, showing the inner side of the shoe.
Figure 5:
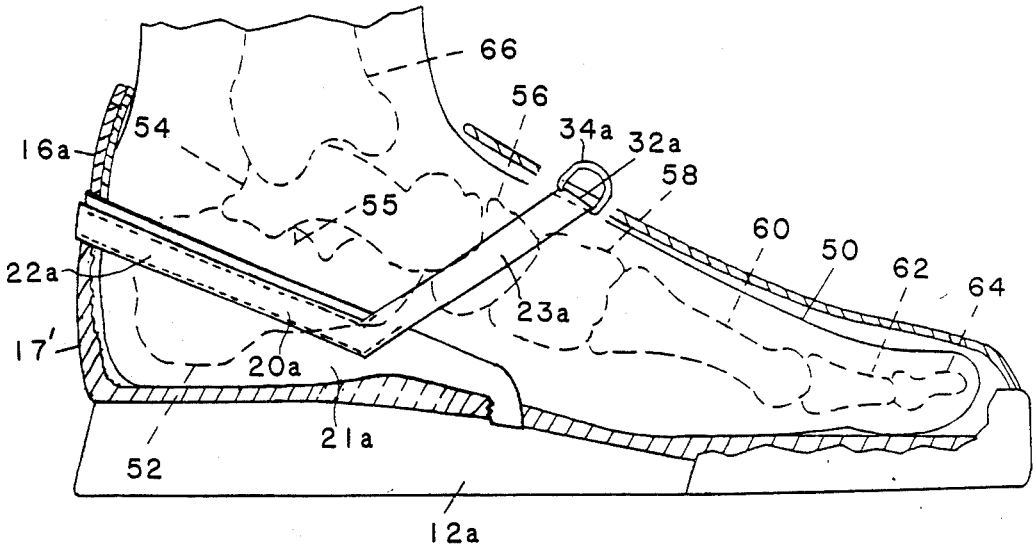
FIG. 5 is a cut-away side view of the shoe shown in FIG. 4, illustrating the anatomical relationship between the bone structure of a foot and the support member of the second embodiment.

The sports shoe 10*a* shown in FIGS. 4–5 includes a sole 12*a*, an upper 16*a* with a foot-receiving opening 18*a* and a toe piece 14*a*, similar to that shown in FIGS. 1–3.

The shoe upper 16*a* includes an overlay 21*a* that extends upwardly from the sole 12*a*, from about midway of the shoe back behind the heel portion 17' of the shoe. The heel portion 17' may include a stiffening member (not shown) similar to element 17*a* in FIGS. 1–3. The overlay 21*a* may be of the same material as the upper, for example leather or nylon, or may be another material.

The support member 20*a*, shown for the inside part of the foot in FIGS. 4–5, includes a free upper end 132*a*, with a means 33*a* for attaching it to the other side of the shoe, in a manner similar to that shown in FIGS. 1–3. The reinforcing member 20*a* includes a first portion 23*a* that extends from the upper end 132*a* downwardly and rearwardly, to extend over the navicular bone 56. The lower end 23*b* of the first portion 23*a* is attached to the overlay 21*a*. Since the overlay 21*a* is attached to the sole 12*a*, the upper end 132*a* of the first portion 23*a* is thereby in tension bearing engagement with the sole 12*a*.

The second portion 22*a* of the reinforcing member 20*a* extends upwardly and rearwardly from the lower end 23*b* of the first portion 23*a*, and back around the rear portion of the shoe 10*a* behind the os calcis bone 52, as shown in FIG. 5. Preferably, the second portion 22*a* is stitched to the overlay portion 21*a*, so as to retain it properly in place.

Although not shown, the portion of the support member 20*a* on the outside of the shoe looks generally the same, i.e. a mirror image of, the inside portion shown in FIG. 4. A third portion of the support member 20*a* is disposed on the outer side of the shoe 10*a*. The third portion has a free upper end disposed opposite to the upper end 31*a*, and extends downwardly and rearwardly from its upper end in a manner similar to portion 23*a* shown, to join the opposite side of the second portion 22*a*. The upper end of the third portion may include an eyelet similar to 34*a* for lacing to eyelet 33*a*.

In the example shown in FIGS. 4–5, the first portion 23*a* passes through a guide slot 31*a*, but is not otherwise attached to the upper 16*a*. The slot 31*a* acts to retain the first portion 23*a* in place, for convenience in tying the shoe. The portion 23*a* may either be rigid, or may be slightly resilient, but lacing forces through the eyelet 34*a* cause the first portion 23*a* to bear against the navicular bone 56 of the foot.

While the support strap 20*a* does not extend all the way to the sole it is nevertheless attached in tension bearing relationship to the sole and also behind the os calcis bone of the foot, as is the case in the embodiment shown in FIGS. 1–3. Accordingly, in both embodiments of the invention the support stirrup 20 or 20*a* provides instantaneous and increasing force as motion takes place against the sides of the foot. The lateral opposing force imparted by the support member inhibits angulation of the foot, thereby decreasing momentum and the amount of work that the correcting muscle structure must perform. Because the muscles are not overcompensating for foot motion, the support member 20, 20*a* in accordance with the invention decreases fatigue. It also increases performance, by reducing the delay in responsiveness of the muscles. When changing direction, muscles that are tensed to overcompensate need to be relaxed and stretched before other muscles can move the foot in the desired direction. Because the muscles will tend to already be relaxed in accordance with the present invention, there is an improvement in the responsiveness of the muscles and therefore in the time to change directions. Also, as discussed above, there is less likelihood of injury to the ankle complex and joints above the sub-talar joints where the muscles are not attempting to overcompensate for movement.

The foregoing represents a description of a preferred embodiment of the invention. Variations and modifications of the structure shown and described herein will be apparent to persons skilled in the art, without departing from the inventive concepts disclosed herein. All such modifications and variations are intended to be within the scope of the invention as described in the following claims.

I claim:

1. A sports shoe having a sole and an upper attached thereto, the upper being made, at least substantially, of relatively pliable material and having opposite sides, one side corresponding to the inner side of the foot, and the other side corresponding to the outer side of the foot, and the upper also having a back portion adapted to wrap around the heel of the foot, and a supporting means including a tension bearing support member, made of a relatively rigid, high modulus, low elongation material, on the side of the upper corresponding to the inner side of the foot, said support member having a free upper end and extending downwardly and rearwardly over an area of the navicular bone of the foot, means for rigidly attaching said support member to said back portion, in an area behind the os calcis bone of the foot and for rigidly attaching said member to said sole in an area rearward of said free end, wherein said member is thereby rigidly attached in tension bearing engagement to said sole and back portion, and means for releasably attaching free end in rigid tension bearing engagement to a portion of the sole located on the other side of the upper thereby to provide a non-resilient, medio-lateral support between the os calcis and navicular bones of the foot.

2. A sports shoe as defined in claim 1, wherein said support member extends around the back portion and upward and forward on the other side of the upper and terminates in a distal end lying substantially opposite to said free end, and said support member includes sections on each side of the upper extending downwardly to said sole, to locations rearward of said free and distal ends, respectively, and being rigidly attached to said sole, and wherein the means for releasably attaching said free end includes means for connecting the free end to the distal end in rigid tension-bearing engagement, said member thereby forming a relatively rigid stirrup inhibiting abnormal side-to-side motion of the foot.

3. A sports shoe as defined in claim 2, wherein said member is rigidly attached to the sole in a rear portion thereof, wherein the rear portion of the sole is relatively thick and infexible, and wherein the support member, in the area of the navicular bone of the foot, has a width roughly equivalent to the navicular bone.

4. A sports shoe as defined in claim 2, wherein said support member has outer edges, said outer edges being stiched to said upper.

5. A sports shoe as defined in claim 4, wherein said member is rigidly attached to the sole in a rear portion thereof, wherein the rear portion of the sole is relatively thick and inflexible, and wherein the support member, in the area of the navicular bone of the foot, has a width roughly equivalent to the navicular bone.

6. A sports shoe as defined in claim 1, wherein said member is rigidly attached to the sole in a rear portion thereof, wherein the rear portion of the sole is relatively thick and inflexible, and wherein the support member, in the area of the navilcular bone of the foot, has a width roughly equivalent to the navicular bone.

7. A sports shoe comprising:

a sole;

an upper formed of relatively soft material attached to said sole, said upper including an opening to define a foot receiving space;

a stirrup member made of a relatively rigid, high modulus, low elongation material, said stirrup member having opposed free ends lying forward of said opening, a pair of opposed first portions extending downwardly and rearwardly on either side of the shoe and being rigidly attached to said sole, and a second portion extending from one of the first portions, around behind the opening, to the other first portion, wherein the first portion on the side of the shoe corresponding to the inner side of the foot is positioned at least substantially to extend downwardly and rearwardly over the navicular bone of the foot, and wherein the second portion is positioned to extend behind the os calcis bone of the foot; and fastening means for releasably attaching said free ends of the stirrup member to one another in rigid tension bearing engagement.

8. A sports shoe as defined in claim 7, wherein said stirrup member overlies the upper, wherein said stirrup member, in the area of the navicular bone, has a width roughly equivalent to the navicular bone, wherein the first portions are rigidly attached to the sole in a rear portion thereof, and wherein the rear portion of the sole is relatively thick and infelxible.

9. A sports shoe as defined in claim 8, wherein said stirrup, except for the free ends, is attached to the upper.

10. A sports shoe as defined in claim 8, wherein the upper has a heel portion with a stiffening means therein between said stirrup member and the sole for form a unitary stiff shoe heel portion.

11. A sports shoe as defined in claim 8, including shoe lacing members attached to the upper, and wherein the fastening means includes a lacing member on each free end for cooperating with the shoe lacing members for tying the shoe.

12. A sports shoe comprising:

a sole having forward and rear portions, the rear portion being relatively thick and inflexible;

an upper formed of relatively soft material attached to said sole, said upper including an opening to define a foot receiving space;

a stirrup member, made of a relatively rigid, high modulus, low elongation material, said stirrup member having opposed free ends lying forward of said opening, a pair of opposed first portions extending downwardly and rearwardly on either side of the shoe to a pair of respective means for connecting, in rigid tension bearing engagement, the lower end portions of the stirrup members, lying on opposite sides of the shoe, to the rear portion of the sole, wherein the first portion on the side of the shoe corresponding to the inner side of the foot is positioned to extend downwardly and rearwardly over the navicular bone of the foot, and wherein the second portion is positioned to extend behind the os calcis bone of the foot; and fastening means for releasably attaching said free ends to one another in rigid tension bearing engagement.

13. A sports shoe as defined in claim 12, wherein at least a portion of said rigid stirrup member is stitched to the upper.

14. A sports shoe as defined in claim 12, wherein said stirrup member, in the area of the navicular bone, has a width less than that of the navicular bone.

* * * * *

UNITED STATES PATENT AND TRADEMARK OFFICE

CERTIFICATE OF CORRECTION

PATENT NO. : 4,670,998

DATED : June 9, 1987

INVENTOR(S) : Stephen M. Pasternak

It is certified that error appears in the above-identified patent and that said Letters Patent is hereby corrected as shown below:

Col. 6, line 6, after "attaching" insert --said--;

Col. 6, line 33, "stiched" should read --stitched--;

Col. 7, line 7, "infelxible" should read --inflexible--;

Col. 7, line 13, "for form" should read --to form--;

Col. 8, line 6, after "respective" insert --lower end portions, and a second portion extending from the lower end portion of each first portion upwardly and rearwardly and around behind the opening;--

Signed and Sealed this

Fifteenth Day of December, 1987

*Attest:*

DONALD J. QUIGG

*Attesting Officer*

*Commissioner of Patents and Trademarks*